US011981470B2

(12) United States Patent
Beck et al.

(10) Patent No.: US 11,981,470 B2
(45) Date of Patent: May 14, 2024

(54) METHOD AND DEVICE FOR PROCESSING A COVER OF A PACKAGE

(71) Applicant: Syntegon Technology GmbH, Waiblingen (DE)

(72) Inventors: Martin Beck, Pluederhausen (DE); Ruediger Karcher, Lorch (DE); Hans-Peter Stadel, Lorch (DE); Ulrich Wieduwilt, Schwaebisch Gmuend (DE); Uwe Stroinski, Waiblingen (DE)

(73) Assignee: Syntegon Technology GmbH, Waiblingen (DE)

( * ) Notice: Subject to any disclaimer, the term of this patent is extended or adjusted under 35 U.S.C. 154(b) by 304 days.

(21) Appl. No.: 17/602,325

(22) PCT Filed: Mar. 4, 2020

(86) PCT No.: PCT/EP2020/055713
§ 371 (c)(1),
(2) Date: Oct. 8, 2021

(87) PCT Pub. No.: WO2020/207670
PCT Pub. Date: Oct. 15, 2020

(65) Prior Publication Data

US 2022/0194645 A1 Jun. 23, 2022

(30) Foreign Application Priority Data

Apr. 11, 2019 (DE) ..... 10 2019 205 171.5

(51) Int. Cl.
*B65B 57/04* (2006.01)
*B65B 9/04* (2006.01)
(Continued)

(52) U.S. Cl.
CPC ..... *B65B 57/04* (2013.01); *B65B 9/04* (2013.01); *B65B 41/18* (2013.01); *B65H 23/046* (2013.01);
(Continued)

(58) Field of Classification Search
CPC ..... B65B 41/18; B65B 57/04; B65B 9/04; B65H 2301/5124; B65H 23/04;
(Continued)

(56) References Cited

U.S. PATENT DOCUMENTS 6,092,002 A 7/2000 Kastman et al.
11,577,869 B2 * 2/2023 Mayer ..... B65H 23/18
(Continued)

FOREIGN PATENT DOCUMENTS

DE 2349475 A1 4/1974
DE 3026856 A1 2/1982
(Continued)

OTHER PUBLICATIONS

Japanese Patent Office Notice of Reasons for Refusal for Application No. 2021-533787 dated Jun. 8, 2022 (9 pages including English translation).
(Continued)

*Primary Examiner* — Carson Gross
(74) *Attorney, Agent, or Firm* — Michael Best & Friedrich LLP

(57) ABSTRACT

The present invention relates to a method for processing a covering roll sheet (20) of a package, wherein the covering roll sheet (20) covers a package body (51) in the manner of a lid, comprising the steps of: drawing the covering roll sheet (20) off an endless roll (22), tensioning the covering roll sheet (20), determining an offset between a first marking on the covering roll sheet (20) and a second marking (34) on the package body (51), and stretching the covering roll sheet
(Continued)

(20) in a manner dependent on the determined offset between the first marking (33) and the second marking (34).

13 Claims, 2 Drawing Sheets

(51) Int. Cl.

| | |
|---|---|
| ***B65B 11/00*** | (2006.01) |
| ***B65B 41/18*** | (2006.01) |
| ***B65H 23/04*** | (2006.01) |
| ***B65H 23/188*** | (2006.01) |

(52) U.S. Cl.
CPC ..... *B65H 23/1886* (2013.01); *B65H 23/1888* (2013.01); *B65B 2011/002* (2013.01); *B65H 2301/5124* (2013.01); *B65H 2701/191* (2013.01)

(58) Field of Classification Search
CPC .. B65H 23/046; B65H 23/048; B29C 66/849; B32B 38/1825
See application file for complete search history.

(56) References Cited

U.S. PATENT DOCUMENTS

| | | | | |
|---|---|---|---|---|
| 2007/0056252 | A1* | 3/2007 | Wetter | B65B 9/04 53/556 |
| 2009/0260739 | A1 | 10/2009 | Fischer et al. | |

FOREIGN PATENT DOCUMENTS

| | | | | | |
|---|---|---|---|---|---|
| DE | 10243084 | B3 | | 1/2004 | |
| EP | 0270109 | A2 | | 6/1988 | |
| EP | 2444324 | A1 | | 4/2012 | |
| JP | 2003012031 | A | | 1/2003 | |
| JP | 2006168750 | A | | 6/2006 | |
| JP | 2010105688 | A | | 5/2010 | |
| TW | 201702127 | A | * | 1/2017 | B65B 1/30 |
| WO | WO-2019026316 | A1 | * | 2/2019 | B65B 11/52 |

OTHER PUBLICATIONS

Translation of International Search Report for Application No. PCT/EP2020/055713 dated May 27, 2020 (3 pages).
International Preliminary Report on Patentability for Application No. PCT/EP2020/055713 dated Sep. 28, 2021 (6 pages).

* cited by examiner

METHOD AND DEVICE FOR PROCESSING A COVER OF A PACKAGE

BACKGROUND

The present invention relates to a method and a device for processing a cover of a package, in particular coated covering paper for sealing a deep-drawn container, and to a packaging machine.

In the case of packaging, in particular packaging for food, it is known that a packaging body is produced from one web, for example by means of deep-drawing, and is then sealed with a covering film from a further web. The cover web is hereby aligned with the edges of the shaped packaging body which has in the meantime been filled with the product to be packaged. This method has generally proved its worth and is applied in particular in the case of thermoplastic materials. However, attempts have recently been made, from an environmental perspective, to produce packaging as much as possible from recyclable materials such as, for example, paper materials. Paper materials can hereby be used exclusively or, for example, also composite materials which consist of a paper material coated with plastic. Because the paper materials consist of fibers, it can be harder to align the lid web relative to the packaging body at the edges and this can lead to visually unattractive results.

SUMMARY

The method according to the invention for processing a cover web of a package for sealing a packaging body has in contrast the advantage that it is possible to synchronize simply and reliably the packaging body which receives the product to be packaged and the cover web which forms the lid of the package such that it is then possible to fix the cover web optimally and in a precise position on the packaging body. According to the invention, correct positioning of the lid on the packaging body can thus be enabled such that the package has a visually appealing overall appearance. This is achieved according to the invention by the method having the steps of unreeling the cover web from an endless reel and tensioning the unreeled cover web. A misalignment is then determined between a first mark on the cover web for the cover and a second mark on the packaging body which is preferably likewise formed from a web, or on a packaging body web. The cover web is then stretched or expanded depending on the determined misalignment between the first and second mark. The stretching causes plastic deformation of the cover web, wherein the plastic deformation is preserved in all the subsequent method steps. An orientation of the cover for the respective packaging body, controlled precisely and individually for each individual package, can thus be enabled such that the cover can always be fixed in a precise position on the packaging body.

After being unreeled from the endless reel, the cover web is preferably guided over a dancer roll arrangement. The dancer roll arrangement is hereby an arrangement of a plurality of rolls, in particular at least three rolls, wherein at least one of the rolls can be moved perpendicular to its axis of rotation. Continuous unreeling of the cover web from the reel can thereby be enabled and the stretching process performed when the cover web is stationary. The dancer roll arrangement thus serves to adjust the short periods of time when the web is stationary owing to the intermittent processing at the stretching station.

The cover web is preferably stretched in just one direction. The stretching particularly preferably takes place in the transporting direction of the cover web.

The cover web is preferably a composite material comprising a paper material with a coating, in particular a plastic coating. Alternatively, the cover web material is exclusively a paper material with no coating.

More preferably, the cover web is clamped at at least two points during the stretching step and the stretching process is then performed by means of an elongated expanding device, for example an elongated roll or an elongated bar. The width of the cover web is here preferably smaller than the length of the expanding device. More preferably, the elongated expanding device is here arranged transversely with respect to the transporting direction of the cover web. A uniform expanding process in the transporting direction of the cover web can be ensured as a result.

To carry out the stretching, travel of the elongated expanding device is particularly preferably performed perpendicular to a longitudinal axis of the elongated expanding device depending on the determined misalignment between the first and second mark. The travel, which is perpendicular to the cover web, thus represents the parameter to be set for the expanding process for the cover web and can thus be set individually for each stretching process.

The method according to the invention moreover comprises, in a subsequent step after the stretching, the step of fixing the cover web on the packaging body, into which the product with which the latter is to be filled is introduced. The individual packages are then partially or preferably completely separated but are still joined together via the cover web or the packaging body web from which the packaging bodies were produced.

The packaging body, which is sealed by the cover web, is preferably likewise produced from a composite material, comprising paper, and a coating, or alternatively completely from a paper material with no coating.

The present invention moreover relates to a device for processing a cover web of a package, which comprises an unreeling device for unreeling the cover web from an endless reel, a first mark-detection sensor, and a second mark-detection sensor. The first mark-detection sensor is configured to detect a first mark on the cover web. The second mark-detection sensor is configured to detect a second mark on a packaging body of the package into which the product with which the latter is to be filled is placed into a depression or the like, or on a packaging body web. The device furthermore comprises a stretching device which is configured to perform a stretching process on the cover web. A control unit is moreover provided which is configured to perform the stretching process based on a detected misalignment between the first and second mark. The abovementioned advantages of the method according to the invention are realized as a result.

The device preferably has a control unit which is configured to determine, based on the detected misalignment, a force to be exerted on a section of the cover web which is to be stretched. The force to be exerted is here preferably determined by a predetermined distance traveled by the stretching device in contact with the cover web in order to perform the stretching process.

The stretching device particularly preferably comprises an elongated expanding device which is arranged transversely to the transporting direction. The elongated expanding device is, for example, an elongated roll or an elongated bar. The length of the elongated expanding device is here preferably greater than the width of the cover web.

The device more preferably comprises a clamping device. The clamping device is configured to clamp a section of the cover web which is to be stretched during the stretching process. A high degree of accuracy of the stretching process is consequently ensured. The clamping device is moreover preferably configured to also pretension the section which is to be stretched in a crease-free manner.

The device more preferably comprises a dancer roll arrangement with at least three rolls. As a result, continuous unreeling of the cover web from the endless reel can be made possible and the stretching process can be performed when the cover web is stationary. The dancer roll arrangement here ensures that it is possible to make adjustments because the cover web continues to be unreeled continuously from the reel.

The device according to the invention is preferably used with a material which comprises coated paper or is produced exclusively from paper.

The invention moreover relates to a packaging machine with a device according to the invention.

BRIEF DESCRIPTION OF THE DRAWINGS

A preferred exemplary embodiment of the invention is described in detail below with reference to the attached drawings, in which.

DETAILED DESCRIPTION

A device 1 for processing a cover web 20 and an associated processing method for the cover web 20 is described below in detail with reference to FIGS. 1 to 3.

Figure 1:
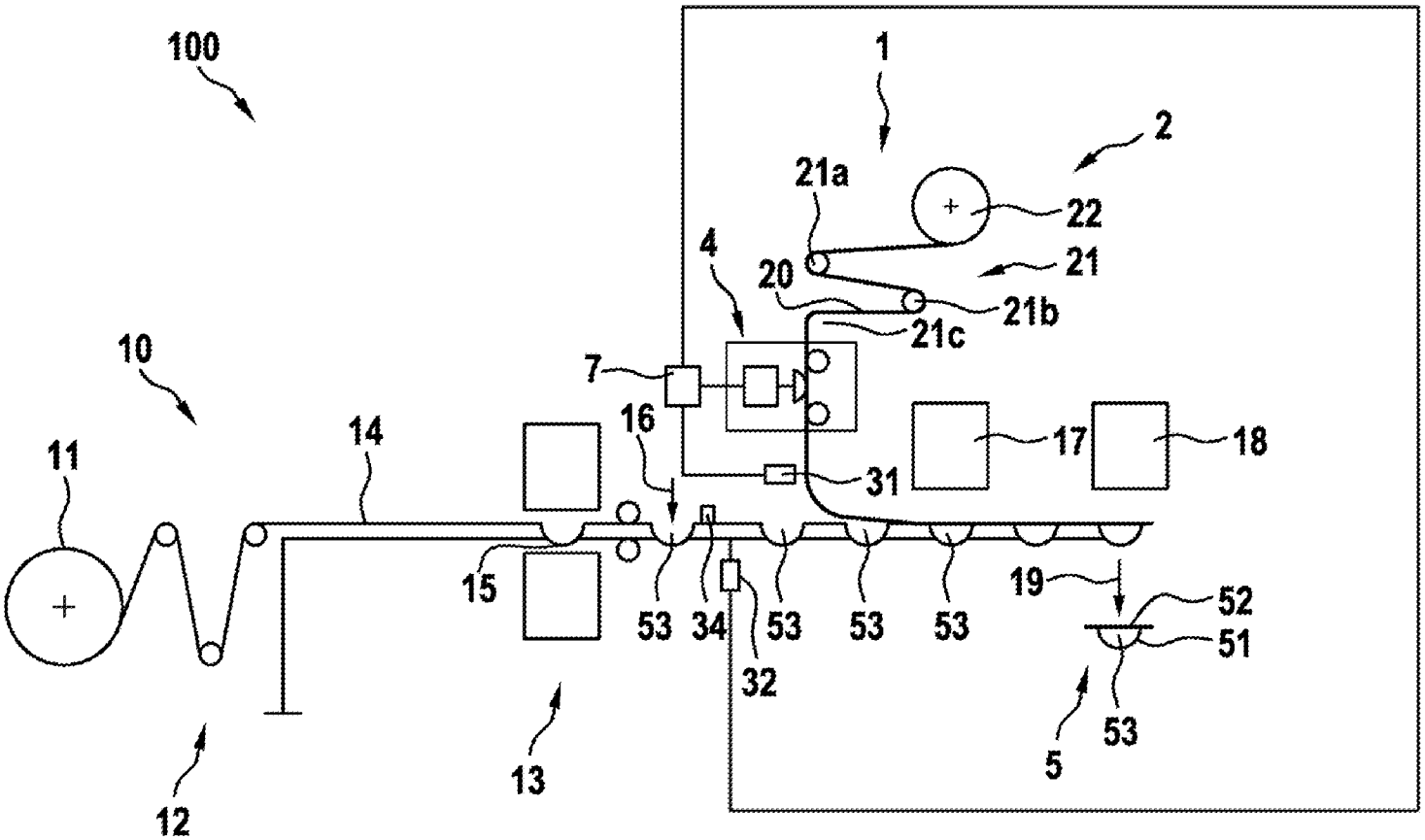
FIG. 1 shows a schematic view of a device for processing a cover web in an overall view with a packaging machine according to the present invention.

As can be seen from FIG. 1, the device 1 for processing the cover web is part of a packaging machine 100 for producing and filling a package 5. The package 5 comprises a packaging body 51 and a lid 52. The packaging body 51 has a cavity 53 for receiving a product to be packaged, for example a foodstuff, and the lid 52 covers the package 5.

The packaging machine 100 also comprises, in addition to the device 1 for processing the cover web 20, a machine part 10 for producing the packaging body 51. The machine part 10 here comprises an endless reel 11 with an unreeling device and a dancer roll arrangement 12 and a shaping unit 13 which introduces a depression 15, which defines the cavity 53 of the package, into the endless web 14 of the packaging body. A product which is to be packaged is placed into the depression 15, as indicated schematically by the arrow 16 in FIG. 1. The filled depression 15 is then sealed by a cover web, as explained in detail below.

The device 1 for processing the cover web 20 here comprises an unreeling device 2 which unreels the cover web from an endless reel 22. The unreeling here takes place continuously. The unreeling device 2 moreover comprises a dancer roll arrangement 21 with three rolls 21*a*, 21*b*, 21*c*. The dancer roll arrangement 21 thus enables the cover web 20 to be able to be unreeled continuously from the reel 22 and the cover web 20 nevertheless to be processed in a stretching device 4 when stationary.

Figure 2:
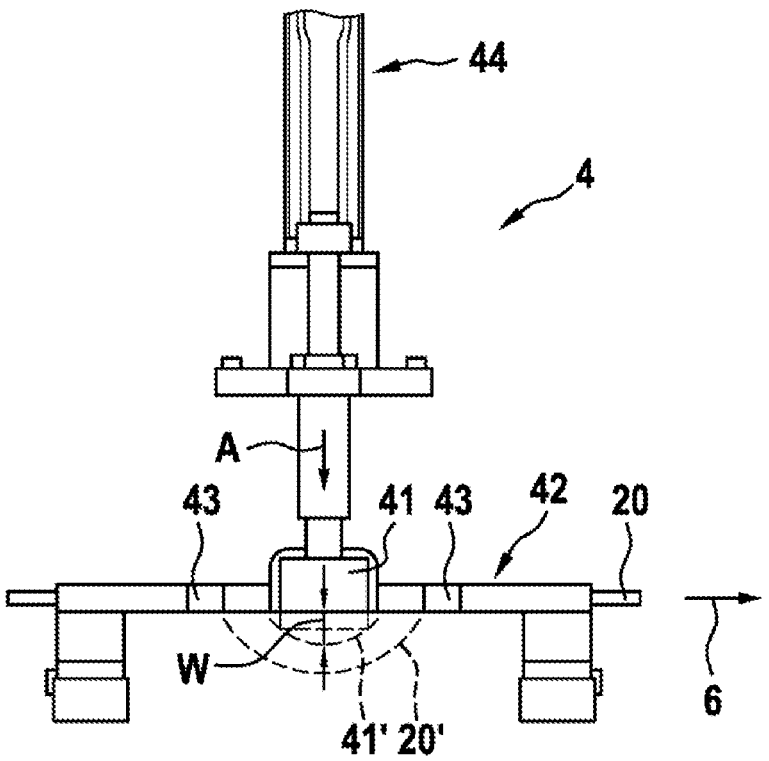
FIG. 2 shows a schematic side view of a stretching device from FIG. 1.
Figure 3:
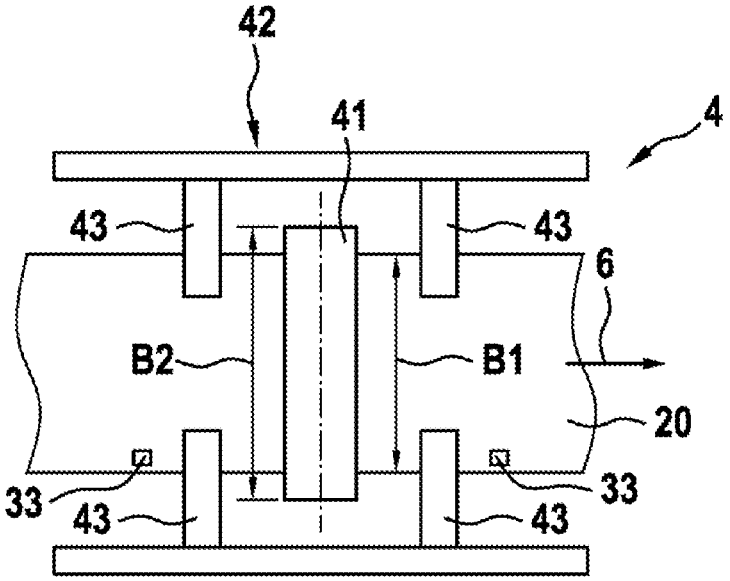
FIG. 3 shows a schematic plan view of the stretching device from FIG. 2.

The stretching device 4 is likewise part of the device 1 for processing the cover web 20 and is shown in detail in FIGS. 2 and 3. The stretching device 4 here comprises an elongated expanding device 41 in the form of an elongated bar. The cover web 20 here has a first width B1 which is smaller than a second width B2 of the elongated expanding device 41.

As shown in FIG. 3, the elongated expanding device 41 is here arranged transversely to a transporting direction 6 of the cover web 20.

The stretching device 4 moreover comprises a clamping device 42 which can clamp the cover web 20 at both free sides. For this purpose, the clamping device 42 has four clamping jaws 43.

The stretching device 4 moreover comprises a fluid drive 44 which moves the elongated expanding device 41 downward in the direction of the arrow A. As can be seen in FIG. 2, the elongated expanding device 41 is here arranged in the section between the clamping jaws 43 which clamp the cover web 20.

The device 1 for processing the cover web 20 moreover comprises a sensor device with a first detection sensor 31 and a second detection sensor 32. The first detection sensor 31 here detects a first mark 33 which is provided on the cover web 20. The second detection sensor 32 detects a second mark 34 which is arranged on the web 14 for the packaging body 51. A corresponding mark is hereby provided on each of the webs per packaging body 51 and per lid 52. The second mark 34 is indicated schematically in FIG. 1.

The device 1 furthermore comprises a control unit 7 which is connected to the first detection sensor 31 and the second detection sensor 32. The control unit 7 is moreover also connected to the stretching device 4 and controls the latter.

The detected positions of the marks 33, 34 which are detected by means of the first and second detection sensor 31, 32 are fed to the control unit 7. The control unit 7 then carries out a target/actual comparison with saved target positions for the marks and thus determines a possible misalignment between the first and second mark 33, 34.

The control unit 7 is thus configured to actuate the stretching device 4 based on this possible misalignment. A traveling distance W is hereby determined, based on the detected misalignment, by which the elongated expanding device 4 is moved in the direction of the arrow A in order to enable that section of the cover web 20 which is clamped between the clamping jaws 43 to be stretched or expanded. The traveling distance W and also, in dashed lines, the position of the cover web 20' and of the elongated expanding device 41' are indicated in FIG. 2.

The method according to the invention for processing the cover web 20 to provide a cover 52 for the packaging body 51 thus includes the steps of unreeling the cover web 20 from the endless reel 22 and tensioning the cover web 20 by clamping the cover web 20 between the clamping jaws 43. A possible misalignment between the first mark 33 on the cover web 20 and the second mark 34 on the web 14 for the packaging body 51 has preferably also been determined at the same time and fed to the control unit 7. A step of stretching the cover web 20 then takes place in the clamped state depending on the determined misalignment between the first and the second mark 33, 34.

The stretching step here takes place in the clamped state of the cover web 20, i.e. this region of the web is stationary. So that the cover web 20 can continue to be unreeled continuously from the endless reel 22, the dancer roll arrangement 21 is provided which makes it possible, when the cover web 20 is stationary during the stretching step, to adjust the endless reel 22 which continues to be unreeled continuously. At least one of the rolls of the dancer roll arrangement 21 is here moved perpendicular to its axis of rotation.

Owing to the stretching of the cover web 20, faulty alignment between the two marks can thus be avoided in a subsequent step in which the package is joined together. The cover web 20 and the web 14 for the packaging body 51 are thus fed in a synchronized fashion to a sealing station 17. The two webs are then sealed together in the sealing station 17. The sealed package is then die-cut in a separating station 18 and the package 5 produced in this way is transported away (arrow 19).

The device 1 according to the invention and the method according to the invention are here particularly suitable when paper material is used for the package. Paper material can hereby be used exclusively for both the lower part and the lid of the package. Alternatively, a composite material comprising a paper material and a plastic coating can in particular be used for the lid of the package. As a result, the stretching step can be performed particularly efficiently and in particular the subsequent sealing step can also be performed without any problems.

Position deviations, which can occur for example owing to the use of paper materials for the package, can be in particular be compensated owing to the synchronization. Because the packages are usually printed, variations in the printed image can thus in particular be compensated. As a result, the package 5 which is produced has a visually attractive appearance. Furthermore, a length of the cover web 20 which is aligned for the lid can also be varied by the stretching step. Length adjustment can hereby likewise be determined by determining the misalignment between the first and second mark 33, 34.

It should be noted that the stretching step usually forms plastic deformation of the covering web. It should be noted hereby that the covering web can also have a coating on both the top and the underside which later faces the product.

The invention claimed is:

1. A method for processing a cover web (20) of a package, wherein the cover web (20) covers a packaging body (51) in the manner of a lid, comprising the steps:

unreeling the cover web (20) from an endless reel (22), tensioning the cover web (20), determining a misalignment between a first mark on the cover web (20) and a second mark (34) on the packaging body (51), clamping a section of the cover web (20) between a plurality of clamping jaws (43), stretching the cover web (20) by an elongated expanding device (41) engaging the section of the cover web (20) between the plurality of clamping jaws (43) depending on the determined misalignment between the first mark (33) and the second mark (34).

2. The method as claimed in claim 1, wherein the cover web (20) is guided over a dancer roll arrangement (21) after being unreeled from the endless reel (22).

3. The method as claimed in claim 1, wherein the stretching step takes place in just one direction.

4. The method as claimed in claim 3, wherein the stretching step takes place just in a transporting direction (6).

5. The method as claimed in claim 1, wherein the cover web (20) comprises a composite material comprising paper material and at least one surface coating.

6. The method as claimed in claim 1, wherein the elongated expanding device (41) is arranged transversely to a transporting direction (6) of the cover web.

7. The method as claimed in claim 1, wherein a travel (W) of the elongated expanding device (41) perpendicular to a surface of the cover web (20) is selected depending on the determined misalignment between the first and second mark (33, 34).

8. The method as claimed in claim 1, further comprising the step of fixing the stretched cover web (20) on the packaging body (51).

9. A device for processing a cover web (20) of a package (5), wherein the cover web (20) is configured to cover a packaging body (51) in the manner of a lid, comprising:

an unreeling device (2) for unreeling the cover web (20) from an endless reel (22), a first detection sensor (31) for detecting a first mark (33) on the cover web (20) and a second detection sensor (32) for detecting a second mark (34) on the packaging body (51) or a packaging body web, a plurality of clamping jaws (43) for clamping a section of the cover web (20), a stretching device (4), including an elongated expanding device (41) which is configured to engage the section of the cover web (20) between the plurality of clamping jaws (43) to perform a stretching process, and a control unit (7) which is configured to control the stretching process based on a detected misalignment between the first mark (33) and the second mark (34).

10. The device as claimed in claim 9, wherein the control unit (7) is configured to determine, based on the detected misalignment between the first and second mark (33, 34), a traveling distance (W) by which the elongated expanding device (41) of the stretching device (4) needs to move perpendicular to a surface of the cover web (20) for the stretching process.

11. The device as claimed in claim 9, wherein the elongated expanding device (41) of the stretching device (4) is arranged transversely to a transporting direction (6) of the cover web (20).

12. The device as claimed in claim 9, further comprising a dancer roll arrangement (21) between the endless reel (22) and the stretching device (4).

13. The device as claimed in claim 9, wherein the device is implemented on a packaging machine.

* * * * *